US005912689A

United States Patent [19]

Otsuka et al.

[11] Patent Number: 5,912,689

[45] Date of Patent: Jun. 15, 1999

[54] INK TANK MOUNTED ON AN INK JET APPARATUS

[75] Inventors: Naoji Otsuka; Kentaro Yano, both of Yokohama; Kiichiro Takahashi; Osamu Iwasaki, both of Kawasaki; Daigoro Kanematsu, Yokohama; Hitoshi Nishikori, Kawasaki, all of Japan

[73] Assignee: Canon Kabushiki Kaisha, Tokyo, Japan

[21] Appl. No.: 08/664,645

[22] Filed: Jun. 17, 1996

[30] Foreign Application Priority Data

Jun. 21, 1995 [JP] Japan ..... 7-154551
Jun. 6, 1996 [JP] Japan ..... 8-144475

[51] Int. Cl.[6] ..... B41J 2/175

[52] U.S. Cl. ..... 347/86

[58] Field of Search ..... 347/84, 85, 86, 347/87

[56] References Cited

U.S. PATENT DOCUMENTS 5,113,199 5/1992 Chan et al. ..... 347/87

FOREIGN PATENT DOCUMENTS

A0510665 10/1992 European Pat. Off. ..... B41J 2/175
A0542247 5/1993 European Pat. Off. ..... B41J 2/175
A0571151 11/1993 European Pat. Off. ..... B41J 2/175
A0605183 12/1993 European Pat. Off. ..... B41J 2/175
A0640482 3/1995 European Pat. Off. ..... B41J 2/175
A2281253 3/1995 European Pat. Off. ..... B41J 2/175

*Primary Examiner*—N. Le
*Assistant Examiner*—Judy Nguyen
*Attorney, Agent, or Firm*—Fitzpatrick, Cella, Harper & Scinto

[57] ABSTRACT

An ink tank for storing the ink to be supplied to an ink jet head mounted on an ink jet apparatus for forming an image by discharging multiple different inks, comprising, a first ink vessel for receiving a first ink, as well as having a first atmosphere communicating part for communicating the inside of vessel with the atmosphere, and a first ink supply port for supplying the ink to said ink jet head, and a second ink vessel for receiving a second ink, as well as having a second ink supply port for supplying the ink to said ink jet head, wherein said second ink vessel is disposed within said first ink vessel, with said second ink supply port exposed to the outside

27 Claims, 5 Drawing Sheets

INK TANK MOUNTED ON AN INK JET APPARATUS

BACKGROUND OF THE INVENTION

1. Field of the Invention

The present invention relates to an ink tank for use in an ink jet recording apparatus for performing the recording by discharging the ink from a recording head onto a recording medium.

2. Related Background Art

The recording apparatuses such as a printer, a copying machine and a facsimile can perform the recording of an image composed of dot patterns based on image information onto a recording medium such as a paper or a plastic thin plate.

The above-described recording apparatuses can be classified into an ink jet system, a wire dot system, a thermal system, and a laser beam system, depending on the recording system. Among them, a recording apparatus of the ink jet system can perform the recording by discharging or flying ink (recording liquid) droplets from the discharge orifices of a recording head to attach them onto a recording medium.

In recent years, numerous recording apparatuses have appeared, and been required to realize the faster recording, higher resolution, higher image quality, and lower noise. One of the recording apparatuses which can meet such demands is the ink jet recording apparatus as above mentioned. The ink jet recording apparatus allows for the non-contact printing, because the ink is discharged from the recording head onto the recording medium in printing, and thus can produce very stable recording images.

The ink jet recording apparatus has increasing demands due to its many merits. In particular, one can make the most of such merits for the color printing.

The ink jet recording apparatus having the ability of color printing, in the main current, performs the printing by using four color inks consisting of three colors of C (cyan), M (magenta) and Y (yellow), in addition to Bk (black). Hence, an ink tank is required to store inks of three or four colors as above cited.

FIG. 1 is an appearance view schematically illustrating a conventional ink tank.

The conventional ink tank 600 as shown in FIG. 1 has an atmosphere communicating opening 609 for communicating the air between the inner and outer portions of the ink tank 600, and is mounted on a recording head 601.

The ink tank may be of a separate type in which each color ink is separately stored, or an integral type in which the ink tanks for storing three or four color inks are integrated. Also, the system of ink tank for storing the ink therein may be made by providing a sponge for producing a negative pressure internally, or providing partly a sponge except where the ink is stored as such.

FIG. 2 is a cross-sectional view schematically showing one constitutional example of a conventional ink tank for storing two color inks. This ink tank has the advantage that the ink tank can be disposed in a smaller arrangement space over the ink tank of separate type wherein a separate ink tank is prepared for each color ink, and is mostly used as one example of constitution in the color recording apparatuses.

This conventional example, as shown in FIG. 2, comprises a vessel composed of an outermost vessel 501 and an outer lid 512, this vessel being partitioned by an inner wall 515 into two sections, each comprising an atmosphere communicating opening 509, 508 for communicating the air between the outside and inside of the vessel, a porous member 507, 506 having the ink absorbed up to an ink level as indicated, and an ink supply opening 511, 510 for supplying the ink absorbed in the porous member 507, 506 to the outside. Note that the outermost vessel 501 and the outer lid 502 are thick members, while the inner wall 515 is a thin member.

The outermost vessel 501 and the outer lid 502 are welded together at a welding part 503, the inner wall 515 and the outer lid 502 at a welding part 512, and the outermost vessel 501 and the inner wall 515 at a welding part 513.

This ink tank, which takes such a constitution and is applicable to the recording apparatuses capable of the color printing, has multiple ink tanks simply integrated, with an atmosphere communicating opening for each color disposed on an outer lateral face of each ink tank, whereby there is a higher possibility of ink leakage proportional to the number of ink tanks (for ink colors).

Also, the multi-color tank has a greater length of welding part in making the ink tank than the monochrome tank, resulting in higher possibility of ink leakage due to welding failure or exfoliation. In addition, the welding part 512 between the wall of adjacent tanks (inner wall 515 in FIG. 2) and the outer lid 502, for example, is required to be welded reliably to cause no color mixture of inks, and may be often regulated on manufacture with respect to the process management or welding method.

Furthermore, the ink tank of a type in which the multi-color ink tanks are integrated has a problem that the amount of ink for each color to be stored is relatively small as compared with the ink tank for use on the monochrome recording apparatus. Thus, it is conceived that the amount of ink to be stored may be increased by making thinner the wall between color ink tanks to reduce the wasteful space, but the outer wall susceptible to external forces is usually obliged to be thicker from the aspect of mechanical strength. Thus, the thickness of inner wall is made thinner, but the thickness of outer wall and that of inner wall are greatly different, resulting in unstable welding conditions with a higher probability of welding failure. On the other hand, if the outer wall is made thinner to attain equivalent welding conditions, its mechanical strength becomes weak, with a risk that the ink may be forced out due to an increase in internal pressure of the ink tank, causing ink leakage through the atmosphere communicating opening, for example, when a force is applied to the outer wall.

Also, because the wall between color ink tanks is made thin as above described, its mechanical strength is weak, and when there is a welding part in the region easily touchable from the outside, there is a risk that the welding part is easily peeled off, if an external force is applied to that welding part, and if it is peeled off, there is a risk that a serious problem of ink leakage or color mixture in the ink tank may arise.

SUMMARY OF THE INVENTION

The present invention has been achieved in the light of aforementioned problems associated with the conventional arts, and its object is to provide a reliable ink tank which has a relatively lower probability of causing ink leakage or color mixture for use with a recording apparatus capable of the color printing.

It is another object of the invention to provide an ink tank for storing the ink to be supplied to an ink jet head mounted on an ink jet apparatus for forming an image by discharging multiple different inks, comprising, a first ink vessel for receiving a first ink, as well as having a first atmosphere communicating part for communicating the inside with the atmosphere, and a first ink supply port for supplying the ink to said ink jet head, and a second ink vessel for receiving a second ink, as well as having a second ink supply port for supplying the ink to said ink jet head, wherein said second ink vessel is disposed within said first ink vessel, with said second ink supply port exposed to the outside.

To accomplish the above object, the present invention provide an ink tank comprising at least two sorts of ink storing sections each having an internal pressure transfer mechanism for regulating the internal pressure thereof, in which one storing section contains all other storing sections, characterized in that said internal pressure transfer mechanism of contained-side storing section among said storing sections is in communication with the atmosphere via said internal pressure transfer mechanism of containing-side storing section among said storing sections.

Also, this ink tank is characterized in that at least one of said internal pressure transfer mechanisms is an atmosphere communicating opening.

Also, this ink tank is characterized in that at least one of internal pressure transfer mechanisms of contained-side storing sections among said storing sections is a deformable structure.

Also, this ink tank is characterized in that one of internal pressure transfer mechanisms of contained-side storing sections among said storing sections is disposed at a portion where a negative pressure of containing-side storing section among said storing sections occurs.

Also, this ink tank is characterized in that at least one of internal pressure transfer mechanisms of contained-side storing sections among said storing sections is a gas selective permeating mechanism which can permeate only the gas therethrough.

Also, this ink tank is characterized in that one of internal pressure transfer mechanisms of contained-side storing sections among said storing sections is disposed at a portion where a negative pressure of containing-side storing section among said storing sections occurs.

Also, this invention is characterized by comprising said ink tank, which is mounted on a carriage to perform the recording on the recording medium.

Also, this invention is characterized by comprising said recording head, which discharges the ink onto the recording medium to perform the recording.

In the present invention as above described, the internal pressure of containing-side storing section is regulated by communicating with the atmosphere via an internal pressure transfer mechanism of said storing section, while the internal pressure of contained-side storing section is regulated in such a way that the internal pressure transfer mechanism of said contained-side storing section communicates with the atmosphere via said internal pressure transfer mechanism of containing-side storing section, whereby only one internal pressure transfer mechanism liable to cause ink leakage is in contact with the outside, resulting in lower probability of ink leakage in the ink tank having a plurality of storing sections.

Also, because a plurality of storing sections except for one are provided out of contact with the outside, the wall thickness of storing sections is sufficient with the minimum thickness to store the ink. Thereby, the ink storable amount is increased, and further the work at the welding can be simplified.

DETAILED DESCRIPTION OF THE PREFERRED EMBODIMENTS

The preferred embodiments of the present invention will be described below with reference to the drawings. Note that the examples as described below may be subject to any combination of parts thereof without departing from the scope or spirit of the invention.

First Example

Figure 1:
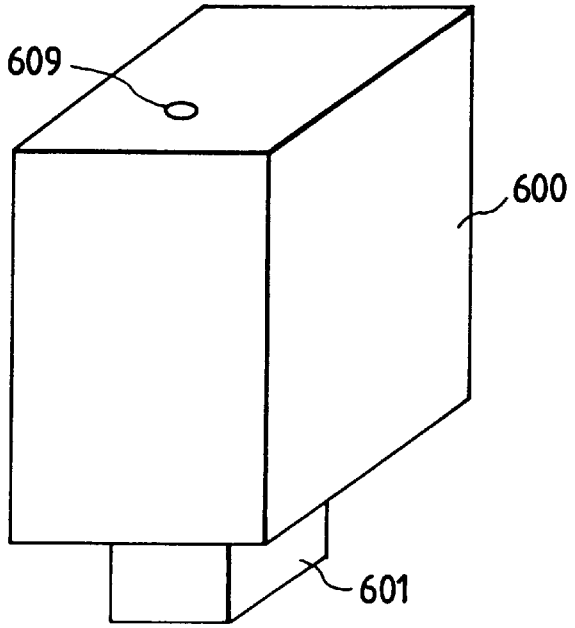
FIG. 1 (PRIOR ART)
FIG. 1 is an appearance view illustrating a conventional ink tank.
Figure 2:
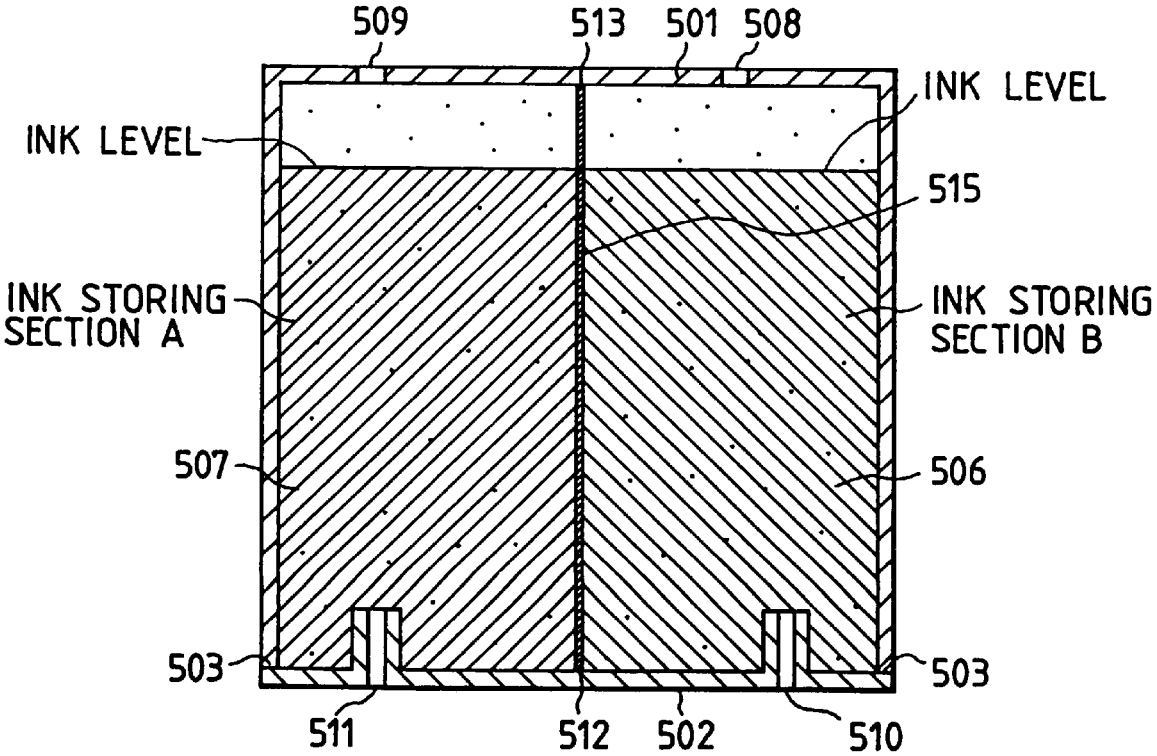
FIG. 2 (PRIOR ART)
FIG. 2 is a cross-sectional view exemplifying one constitution of a conventional ink tank for storing two color inks.
Figure 3:
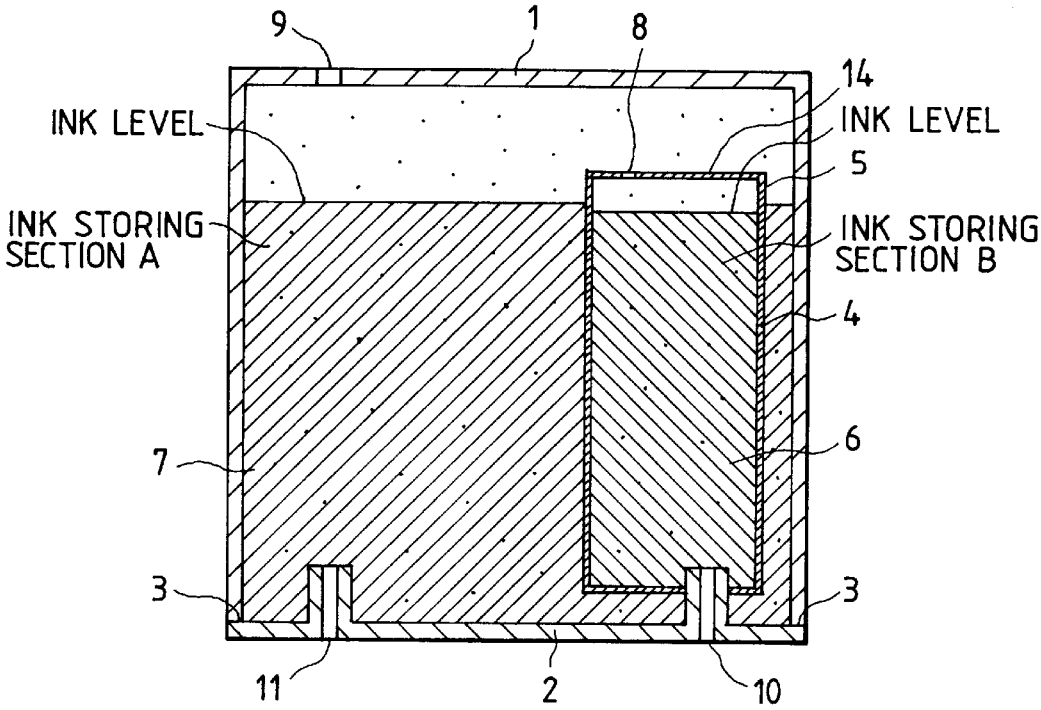
FIG. 3 is a cross-sectional view showing a first example of an ink tank according to the present invention.

FIG. 3 is a cross-sectional view showing a first example of an ink tank according to the present invention.

This example, as shown in FIG. 3, has a storing section A which is on the containing side, comprised of an outermost vessel 1 and an outer lid 2 which are welded at a welding part 3 and having a porous member 7 such as a sponge for storing the ink internally, and a storing section B which is on the contained side, comprised of an inner vessel 4 and a lid 14 which are welded at a welding part 5, and having a porous member 6 such as sponge for storing the ink internally, the storing section B provided within the storing section A. Also, the outermost vessel 1 is provided with an atmosphere communicating opening 9 which is an internal pressure transfer mechanism for communicating the air between the storing section A and the outside, and the lid 14 is also provided with an atmosphere communicating opening 8 which is an internal pressure transfer mechanism for communicating the air between the storing section B and the outside. Further, the outer lid 2 is provided with an ink supply port 11 for supplying the ink within the storing section A to the outside and an ink supply port 10 for supplying the ink within the storing section B to the outside.

In the present invention, the material of ink tank is not limitative, but the ink tank of this example is formed of plastic material.

As for the material or wall thickness of the ink tank as shown in FIG. 3, the outermost vessel 1 and the outer lid 2 which are touchable by hands are formed relatively thicker to prevent deformation, while the inner vessel 4 and the lid 14 which are not touched by hands are unnecessary to increase the mechanical strength to prevent deformation and thus is formed relatively thinner to allow the maximum amount of ink to be stored within the ink tank. Hence, each of the welding part 3 and the welding part 5 is made of a member of the same thickness all around the circumference, and easily subjected to welding process. Note that in the welding process, the member having substantially the same thickness is allowed for wide process conditions and is very favorable for the mass production.

With the constitution as above described, the ink storing section B to be contained is less restrained in construction, with less possibility that the ink storing section B is damaged by an impact being applied from the outside. Also, since only one atmosphere communicating opening to the outside is provided, for example, the probability of causing ink leakage can be equivalent to that of an ink tank of one color. Accordingly, when the ink tank of four colors is constituted, for example, the probability of causing ink leakage is also once that of the ink tank of one color as far as the ink storing sections for three color inks are contained, whereby the trouble of ink leakage can be suppressed to the minimum.

While this first example was described in connection with two storing sections made of plastic material, it should be understood that other materials may be effective in the respect of lower probability of ink leakage or reduced difficulty of connection.

Second Example

Figure 4:
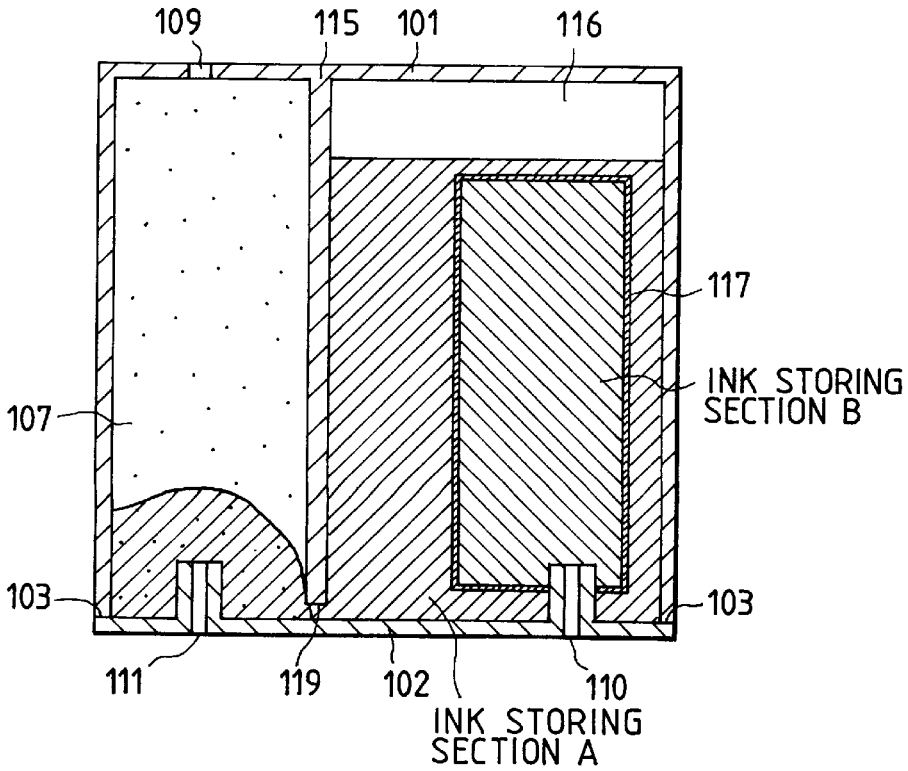
FIG. 4 is a cross-sectional view showing a second example of an ink tank according to the present invention.

FIG. 4 is a cross-sectional view showing a second example of an ink tank according to the present invention.

This example, as shown in FIG. 4, has an ink storing section A which is on the containing side, comprised of an outermost vessel 101 and an outer lid 102 which are welded at a welding part 103 and an ink storing section B which is on the contained side, comprised of a deformable ink bag 117 within which the ink is stored and which is an internal pressure transfer mechanism, the ink storing section B provided within the ink storing section A. Also, the outermost vessel 101 is provided with an atmosphere communicating opening 109 which is an internal pressure transfer mechanism for communicating the air between the storing section A and the outside, and the outer lid 102 is provided with an ink supply port 111 for supplying the ink within the storing section A to the outside and an ink supply port 110 for supplying the ink within the storing section B to the outside. Further, the storing section A is divided by a partition member 115 having a gas/liquid exchange opening 119 into a region where the atmosphere communicating opening 109 and the ink supply port 111 are provided and an ink chamber 116 where the storing section B is provided, a porous member 107 such as sponge for storing the ink being provided on the side where the atmosphere communicating opening 109 and the ink supply port are provided.

The operation of ink tank in supplying the ink will be described below with the above described constitution.

First, a way of supplying the ink within the storing section A through the ink supply port 111 is described.

If the ink is supplied through the ink supply port 111 to the recording head (not shown), the ink within the porous member 107 is partially consumed.

Thus, the negative pressure within the porous member 107 will increase, but beyond a certain negative pressure, the ink stored within the ink chamber 116 is supplied through the gas/liquid exchange opening 119 into the porous member 107, and instead, the air introduced through the atmosphere communicating opening 109 is entered through the gas/liquid exchange opening 119 into the ink chamber 116.

Therefore, the ink chamber 116 is always controlled at a fixed negative pressure level even without any negative pressure generating mechanism such as a sponge.

Next, a way of supplying the ink within the storing section B through the ink supply port 110 is described below.

If the ink is supplied through the ink supply port 110 to the recording head (not shown), the ink in the ink bag 117 is consumed and the ink bag shrinks along with the consumption of the ink.

Then, the negative pressure within the ink chamber 116 increases, so that the ink stored in the porous member 107 is supplied to the ink chamber 116. If the ink is supplied by a fixed amount, the air introduced through the atmosphere communicating opening 109 is passed through the gas/liquid exchange opening 119 into the ink chamber 116, so that the negative pressure level of the ink chamber 116 is maintained at a fixed value.

The main feature of this example is that the ink bag 117 which is a deformable structure can internally produce a constant negative pressure, because the ink chamber 116 is always controlled at a fixed negative pressure level. That is, one negative pressure generating mechanism is commonly used by two ink storing sections. With the above constitution, if an external force such as an impact is applied from the outside, the ink storing section B is not affected, wherein the risk of damage can be sufficiently reduced. Also, the probability of ink leakage remains once that of the monochrome ink tank, and the probability of color mixture can be made as close to zero as possible owing to only one atmosphere communicating opening provided.

Further, because the outermost vessel 101 and the outer lid 102 are made of only a thick member, and very easily welded, wherein since it suffices to provide only one porous member 107 which is a negative pressure generating mechanism for one recording apparatus, the space efficiency is enhanced as more kinds of ink are provided, such as four colors of Y, M, C and Bk, and because the ink bag 117 can be made of very thin material, the space efficiency can be further improved.

While the ink bag 117 was deformable in this example, but the ink bag is not limited thereto, and it will be appreciated that the ink bag may be underformable and provided wholly or partly with a filter capable of permeating only the gas which is a gas selective permeating mechanism with the same effects achieved.

Figure 5:
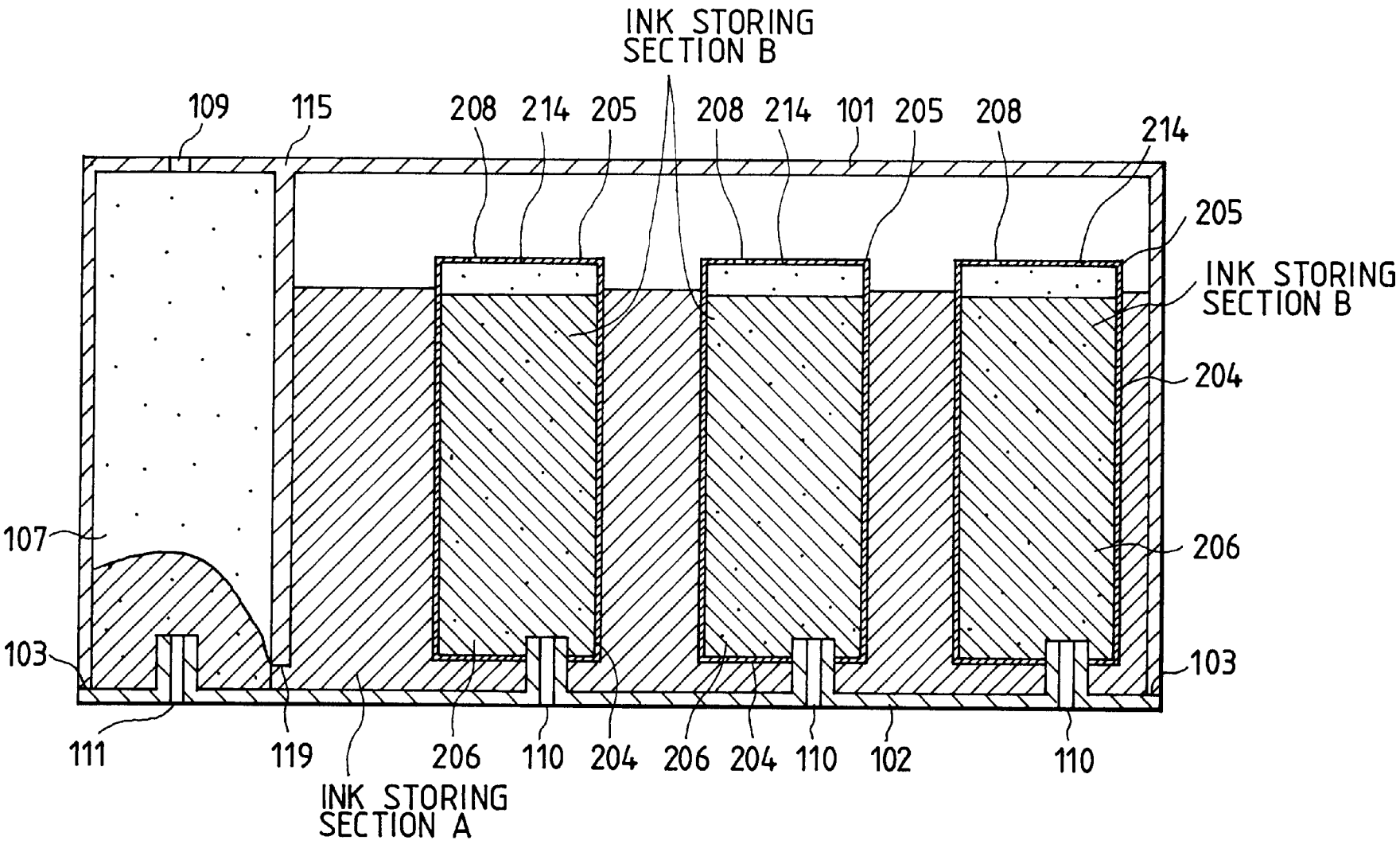
FIG. 5 is a view illustrating an ink tank of four color integral type.

FIG. 5 is a view showing an example of an ink tank of four color integral type.

The ink tank as shown in FIG. 5 has inner vessels 204 which are equivalent to the ink bag 117 of the ink tank as shown in FIG. 4 and made undeformable, each internally filled with a porous member 206 such as sponge as a negative pressure generating mechanism. An inner vessel 204 has a lid 214 welded thereto, having a welding part 205 as well as an atmosphere communicating opening 208. This ink tank has four color inks integrated using three ink storing sections B as above constituted.

When the ink tanks as shown in FIGS. 4 and 5 are used, the evaporation of the ink stored can be suppressed to the minimum because only one atmosphere communicating opening is provided.

When using different kinds of inks, by storing the ink desired to suppress evaporation to the utmost in a storing section contained, the initial performance of the ink can be maintained over long time.

For example, in FIG. 5, color inks are filled in three storing sections to be contained, and Bk ink is filled in an outer storing section to contain, whereby the variation in color balance due to varying dye densities caused by evaporation can be prevented.

Furthermore, by storing the color ink with less consumption than that of Bk ink in the storing sections to be contained which are supposed to have the highest ink use efficiency, the maximum printable sheet number can be obtained with reduced ink consumption.

When using four kinds of inks, the ink in the storing section to be contained will less evaporate, and it is only necessary to fill a slightly excessive amount of ink stored in the outer storing section, in consideration of evaporation at the time of physical distribution or mounting on the printer, so that the space efficiency of ink tank in view of the time range of evaporation can be very enhanced. This effect is further enhanced with the ink using an evaporable solvent such as alcohol.

If ink leakage occurs as the ink tank is dropped or broken by accident, or through a hole opened by mishandling, the ink such as high PH ink, for which ink contamination is desirably reduced to the minimum, should be filled in the storing sections to be contained, resulting in higher safety, because the probability of ink leakage from the storing sections to be contained is smaller.

Third Example

Figure 6:
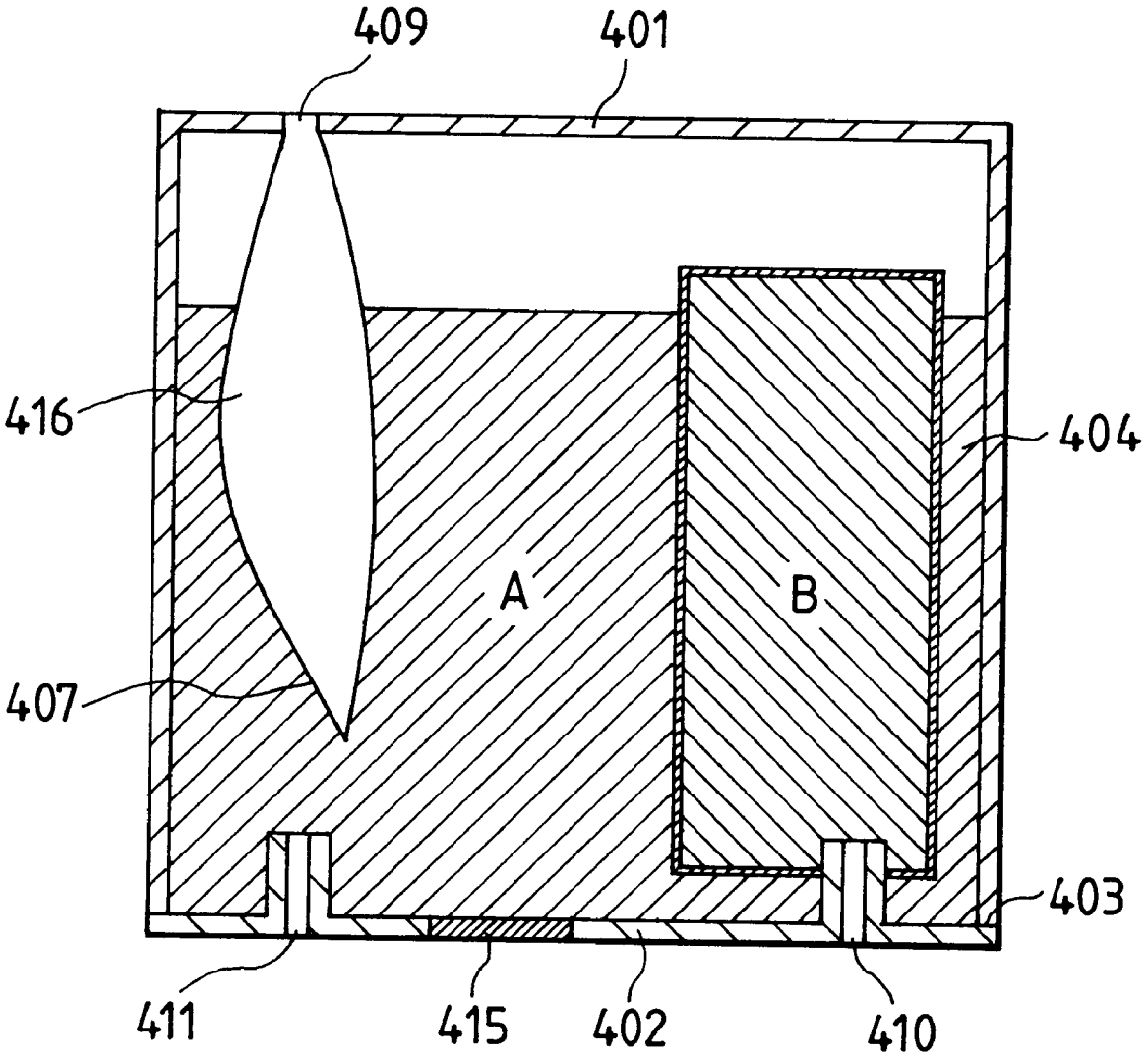
FIG. 6 is a cross-sectional view showing a third example of an ink tank according to the present invention.

FIG. 6 is a view showing the constitution of an ink tank as a third example of the present invention. In FIG. 6, 401 is an outermost vessel which forms a portion touchable by hands most outside of the ink tank. This portion which is touchable by hands is formed relatively thick to have increased mechanical strength to less liable to deformation. 402 is an outer lid for the vessel 401, this outer lid 402 being welded to the outermost vessel 401 at a joint portion 403. A welding part 403 is formed of the same thick member all around its circumference, and thus can be easily welded. 404 is an ink bag deformable by the pressure for storing the B ink. 409 is an atmosphere communicating opening for the volume of storing the ink A. 410 is an ink supply port B for delivering the ink B to a recording head. 411 is an ink supply port B for delivering the ink A to the recording head. 407 is a leaf spring for generating a negative pressure within the ink tank of this example. 416 is a deformable bag. The leaf spring 407 is contained in the bag 416 and deformed in a direction of minimizing the inner volume of the bag 116. 415 is a pressure regulating valve for introducing the air from the outside, upon the negative pressure within the outermost vessel 401 exceeding a fixed value. The operation with the above constitution is described in order.

First, if the ink is consumed by discharge or recovery operation through the ink supply port A, the negative pressure within the ink tank 401 will increase. Then, the air is introduced from the atmosphere communicating opening 409 into the bag 416, which is then inflated to exert a force in a direction of resolving a negative pressure produced. Thereafter, the leaf spring 416 is charged with a force to be exerted in a direction of reducing the volume of bag. Hence, the ink tank is held at a fixed negative pressure internally. Furthermore, if the ink is continuously consumed, the negative pressure becomes too high due to reaction of the leaf spring 416, activating the pressure regulating valve 415 to introduce the air into the ink tank to reduce the pressure. Then, it follows that the bag 416 returns to its proper size, and the leaf spring 407 returns to its proper range of charging force.

Then, a way of consuming the ink B contained within the ink bag is described below. Also in this case, if the ink is consumed through the ink supply port B 410 by discharge or recovery operation as previously described, the volume of ink bag 404 is reduced. Then, the negative pressure within the ink tank rises exactly in the same way as when the ink A is consumed, and thus the ink tank operates in the same way as when the ink A is consumed. In this way, even if either of the inks A and B is consumed, or they are consumed at the same time, the ink tank can be controlled at its proper negative level.

As above described, by adopting the constitution of the ink tank according to the present invention which shares a negative pressure circuit to provide high efficiency, and contains at least one ink tank within another ink tank, the maximum space efficiency of the ink tank can be attained.

Furthermore, by taking the constitution of the ink tank according to the present invention, the trouble of ink leakage can be prevented positively.

The features of the present invention were described which were applied to the ink tank of the ink jet printer, but the ink tank of the invention is not limited thereto, and the present invention may be effective with any ink tank which can contain a plurality of kinds of liquid within the same vessel.

In the following, a recording head with the above-described ink tank mounted and a recording apparatus with that recording head mounted will be described.

Figure 7:
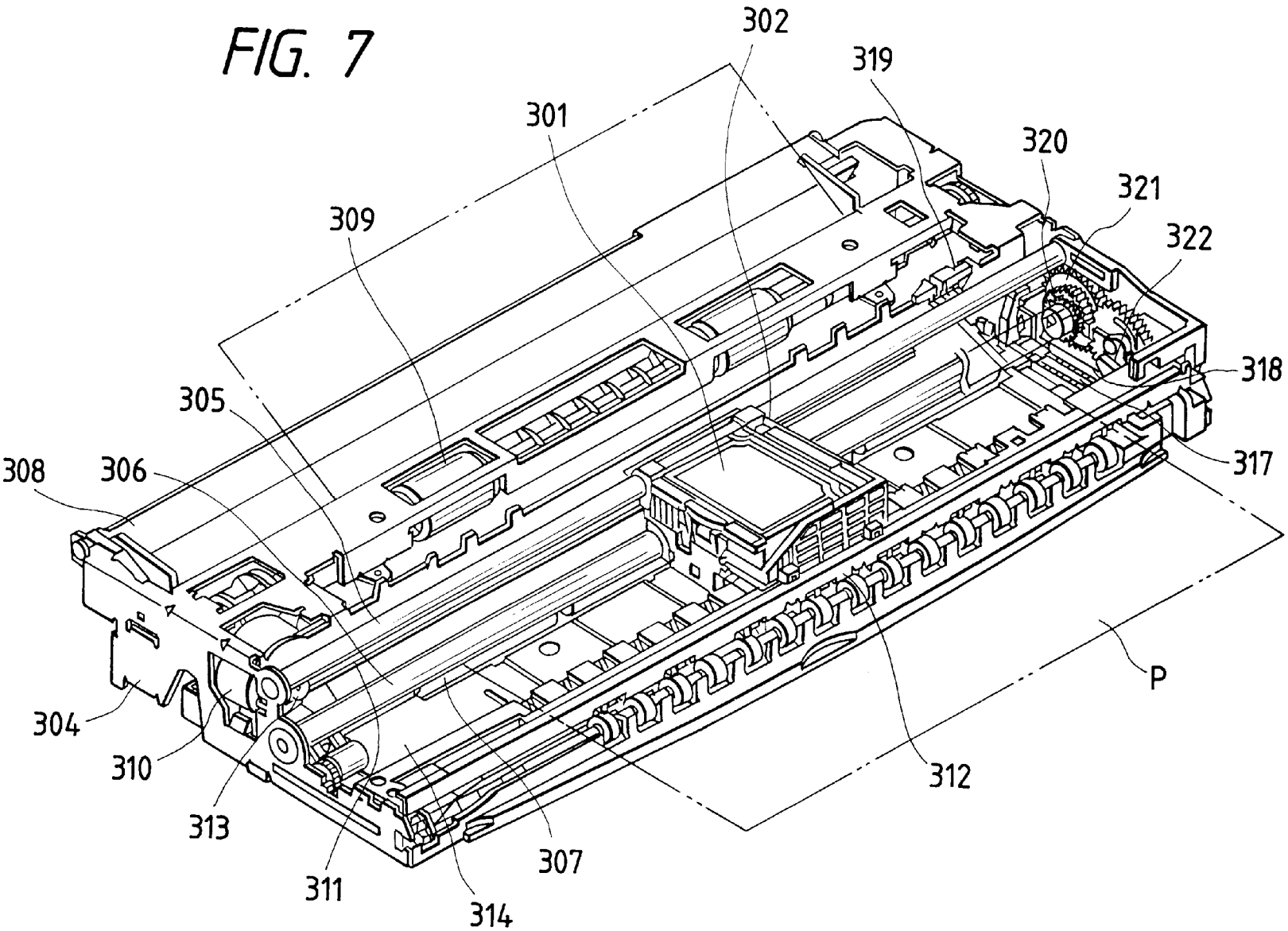
FIG. 7 is a view illustrating a recording apparatus with an ink tank of the invention mounted thereon.

FIG. 7 is a view showing one example of the recording apparatus with the ink tank of the present invention mounted thereon.

The ink jet recording apparatus as shown in FIG. 7 at least comprises a pick-up roller 309 for feeding the recording medium P, a conveying roller 306 and a pinch roller 307, a recording head 301 which is recording means for recording on the recording medium P, a carriage 302 having the recording head 301 mounted thereon, a guide shaft 305 and a guide rail 312, its both ends secured to a frame 304, for supporting slidably the carriage 302 in a direction orthogonal to the conveying direction of the recording medium P and parallel to the surface of the recording medium P, a carriage driving belt 311, a carriage driving motor 310 and a driving pulley 313 for reciprocating the carriage 302 linearly, a home position sensor 319 for controlling the stop position of carriage 302, a pressure plate 308 and a base 314.

Also, outside the recording area are provided a wiper 318 and a cap 317 for effecting the cleaning and capping operation of the recording head 301, at one end of the conveying roller 306 being provided an LF gear 321 for transmitting a motive force of the conveying motor (not shown) to the conveying motor 306, further a clutch gear 320 and a pump gear 322 for transmitting a motive force from the LF gear 321 to the cap 317.

With the above constitution, if the pick-up roller 309 and the conveying roller 306 are rotated, the recording medium P is pulled and fed to a position opposed to the ink discharge face of the recording head 301. Then, the carriage driving motor 310 drives the driving belt 311 for rotation, enabling the carriage 302 to be reciprocated linearly along the guide shaft 305 and the guide rail 312. At the same time, the ink is discharged from the recording head 301 mounted on the carriage 302 in accordance with a recording signal to record the recording contents on the recording medium P.

The present invention as above described has the following effects.

In the ink tank having a plurality of storing sections, one storing section contains all other storing sections, and an internal pressure transfer mechanism of contained-side storing section is in communication with the atmosphere via an internal pressure transfer mechanism of containing-side storing section, whereby one internal pressure transfer mechanism liable to cause ink leakage is only in touch with the outside, resulting in reduced probability of ink leakage in the ink tank having a plurality of storing sections, and less probability of color mixture which can be made as close to zero as possible through only one atmosphere communicating opening.

Also, since the storing section on the contained side is provided out of touch with the outside, the wall thickness of storing sections is sufficient with the minimum thickness to store the ink. Thereby, the storable amount of ink can be increased.

Furthermore, the wall thickness of storing sections can be constant, resulting in simplified work at the time of welding, while the ink leakage through the welding part after welding can be prevented.

What is claimed is:

1. An ink tank for storing ink to be supplied to an ink jet head mounted on an ink jet apparatus for forming an image by discharging multiple different inks including first and second inks, comprising:

a first ink vessel comprised by a first outer housing member having an inside, said first ink vessel for receiving the first ink, said first ink vessel having a first atmosphere communicating opening for communicating an interior of said first ink vessel with ambient atmosphere, and having a first ink supply port for supplying the first ink to said ink jet head; and a second ink vessel comprised by a second outer housing member, said second ink vessel for receiving the second ink and having a second ink supply port for supplying the second ink to said ink jet head;

wherein an entirety of the second outer housing member of said second ink vessel is disposed within the inside of the first outer housing member of said first ink vessel, with said second ink supply port being provided through said first outer housing member.

2. An ink tank according to claim 1, wherein said second ink vessel has a second atmosphere communicating opening to provide a communicating state with ambient atmosphere via said first atmosphere communicating opening.

3. An ink tank according to claim 2, wherein said first ink vessel and said second ink vessel each have a negative pressure generating mechanism.

4. An ink tank according to claim 3, wherein said negative pressure generating mechanism of at least one of said first and second ink vessels is comprised by a porous member for constituting an ink absorber.

5. An ink tank according to claim 1, wherein said first ink vessel has a negative pressure generating mechanism, and wherein said second ink vessel uses the negative pressure generating mechanism of said first ink vessel to maintain a predetermined negative pressure in said second ink vessel.

6. An ink tank according to claim 5, wherein said negative pressure generating mechanism makes use of an elastic member.

7. An ink tank according to claim 5, wherein said negative pressure generating mechanism comprises a partition wall for partitioning said first ink vessel into at least two chambers, and a communicating part disposed at an end portion of said partition wall, wherein one of said at least two chambers is provided with said first ink supply port and said first atmosphere communicating opening, and contains said porous member, while another of said at least two chambers receives the first ink, whereby said negative pressure generating mechanism makes use of gas/liquid exchange which occurs in said communicating part and is caused by supply of the first ink.

8. An ink tank according to claim 1, wherein said first ink vessel and said second ink vessel respectively receive the first and second inks internally.

9. An ink tank according to claim 1, further comprising a plurality of second ink vessels, each of the plurality of second ink vessels being disposed inside the outer housing member of said first ink vessel.

10. An ink tank according to claim 1, wherein said second ink vessel is a rigid container.

11. An ink tank according to claim 1, wherein said second ink vessel is a bag-like deformable container.

12. An ink tank according to claim 1, further comprising a spring-elastic bag member mounted to said first atmosphere communicating opening inside said first ink vessel.

13. An ink tank according to claim 1, wherein said inside of said first ink vessel is partitioned into first and second chambers by a partitioning wall, an ink absorbing member is contained in the first chamber, and the first ink is contained in the second chamber, wherein an end part of said partitioning wall is provided with a communicating part for communicating between said first and second chambers and said second chamber is substantially tightly sealed except for said communicating part, and wherein said second ink vessel is disposed in said second chamber.

14. An ink tank comprising at least first and second storing sections each having an internal pressure transfer mechanism for regulating internal pressure thereof, wherein each said storing section is comprised by an outer housing having an inside, and wherein said inside of said first storing section contains said outer housing of all other storing sections including that of said second storing section;

wherein the internal pressure transfer mechanism of said second storing section is in communication with ambient atmosphere via the internal pressure transfer mechanism of said first storing section; and wherein an ink supply port for said second storing section extends through said outer housing of said first storing section.

15. An ink tank according to claim 14, wherein said internal pressure transfer mechanism of said first storing section is an atmosphere communicating opening.

16. An ink tank according to claim 14, wherein the internal pressure transfer mechanism of said second storing section is a deformable structure.

17. An ink tank according to claim 16, wherein the internal pressure transfer mechanism of said second storing section commonly uses the internal pressure transfer mechanism of said first storing section.

18. An ink tank according to claim 14, wherein the internal pressure transfer mechanism of said second storing section is a gas selective permeating mechanism for permeating only the gas.

19. An ink tank according to claim 18, wherein the internal pressure transfer mechanism of said second storing section is disposed at a portion where a negative pressure of said first storing section is produced.

20. An ink tank according to claim 14, further comprising plural second storing sections, each of the plural second storing sections being contained inside said first storing section.

21. An ink tank according to claim 14, wherein the internal pressure transfer mechanism of said first storing section includes a spring-elastic bag member mounted inside said first storing section.

22. An ink tank according to claim 14, wherein said inside of said first storing section is partitioned into first and second chambers by a partitioning wall, an ink absorbing member is contained in the first chamber, and a first ink is contained in the second chamber, wherein an end part of said partitioning wall is provided with a communicating part for communicating between said first and second chambers and said second chamber is substantially tightly sealed except for said communicating part, and wherein said second storing section is disposed in said second chamber.

23. An ink tank according to claim 14, wherein ink is contained in said ink tank.

24. A recording head mountable to a carriage of an ink jet recording apparatus, said recording head comprising:

plural discharge orifices for discharging droplets of multiple different inks including first and second inks; and an ink tank comprising at least first and second storing sections for respectively storing the first and second inks, each storing section having an ink supply port for supplying ink to at least some of said plural discharge orifices, and each having an internal pressure transfer mechanism for regulating internal pressure thereof, wherein each said storing section is comprised by an outer housing having an inside, and wherein said inside of said first storing section contains said outer housing of all other storing sections including that of said second storing section;

wherein the internal pressure transfer mechanism of said second storing section is in communication with ambient atmosphere via the internal pressure transfer mechanism of said first storing section; and wherein an ink port for said second storing section extends through said outer housing of said first storing section.

25. A recording apparatus comprising:

conveying means for conveying a recording medium in a conveyance direction;

a carriage mounted for movement in a direction orthogonal to the conveyance direction;

a recording head mounted on said carriage, said recording head having plural discharge orifices for discharging droplets of multiple different inks, including first and second inks, on a recording medium conveyed by said conveyance means; and an ink tank comprising at least first and second storing sections for respectively storing the first and second inks, each storing section having an ink supply port for supplying ink to at least some of said plural discharge orifices, and each having an internal pressure transfer mechanism for regulating internal pressure thereof, wherein each said storing section is comprised by an outer housing having an inside, and wherein said inside of said first storing section contains said outer housing of all other storing sections including that of said second storing section;

wherein the internal pressure transfer mechanism of said second storing section is in communication with ambient atmosphere via the internal pressure transfer mechanism of said first storing section; and wherein an ink supply port for said second storing section extends through said outer housing of said first storing section.

26. A recording head mountable to a carriage of an ink jet recording apparatus, said recording head comprising;

plural discharge orifices for discharging droplets of multiple different inks including first and second inks; and an ink tank for storing ink for supply to said discharge orifices, said ink tank including a first ink vessel comprised by a first outer housing member having an inside, said first ink vessel for receiving the first ink, said first ink vessel having a first atmosphere communicating opening for communicating an interior of said first ink vessel with ambient atmosphere, and having a first ink supply port for supplying the first ink to some of said plural discharge orifices, and a second ink vessel comprised by a second outer housing member, said second ink vessel for receiving the second ink and having a second ink supply port for supplying the second ink to some others of said plural discharge orifices;

wherein an entirety of the second outer housing member of said second ink vessel is disposed within the inside of the first outer housing member of said first ink vessel, with said second in supply port being provided through said first outer housing member.

27. A recording apparatus comprising:

conveying means for conveying a recording medium in a conveyance direction;

a carriage mounted for movement in a direction orthogonal to the conveyance direction;

a recording head mounted on said carriage, said recording head having plural discharge orifices for discharging droplets of multiple different inks, including first and second inks, on a recording medium conveyed by said conveyance means; and an ink tank for storing ink for supply to said discharge orifices, said ink tank including a first ink vessel comprised by a first outer housing member having an inside, said first ink vessel for receiving the first ink, said first ink vessel having a first atmosphere communicating opening for communicating a interior of said first ink vessel with ambient atmosphere, and having a first ink supply port for supplying the first ink to some of said plural discharge orifices, and a second ink vessel comprised by a second outer housing member, said second ink vessel for receiving the second ink and having a second ink supply port for supplying the second ink to some others of said plural discharge orifices; and wherein an entirety of the second outer housing member of said second ink vessel is disposed within the inside of the first outer housing member of said first ink vessel, with said second ink supply port being provided through said first outer housing member.

* * * * *

UNITED STATES PATENT AND TRADEMARK OFFICE

CERTIFICATE OF CORRECTION

PATENT NO. : 5,912,689

DATED : June 15, 1999

INVENTORS : Naoji Otsuka, et al.

It is certified that error appears in the above-identified patent and that said Letters Patent is hereby corrected as shown below:

COLUMN 3

Line 13, "provide" should read --provides--.

COLUMN 4

Line 2, change "an appearance" to --a--, and change "a" to --the outer appearance of--; and
Line 60, "is" should read --are--.

COLUMN 5

Line 10, "once" should read --one--.

COLUMN 6

Line 20, "once" should read --one--; and
Line 35, "and" should be deleted.

COLUMN 7

Line 4, "less evaporate," should read --evaporate less,--;
Line 24, "most outside" should read --outside--; and
Line 26, "to" (first occurrence) should read --to be--.

UNITED STATES PATENT AND TRADEMARK OFFICE

CERTIFICATE OF CORRECTION

PATENT NO. : 5,912,689

DATED : June 15, 1999

INVENTORS : Naoji Otsuka, et al.

It is certified that error appears in the above-identified patent and that said Letters Patent is hereby corrected as shown below:

COLUMN 12

Line 27, "in" should read --ink--; and
Line 44, "a" should read --an--.

Signed and Sealed this

Ninth Day of May, 2000

*Attest:*

Q. TODD DICKINSON

*Attesting Officer*

*Director of Patents and Trademarks*